US007357767B2

(12) United States Patent
Tsai

(10) Patent No.: US 7,357,767 B2
(45) Date of Patent: Apr. 15, 2008

(54) ADJUSTABLE BALANCE BOARD WITH FREELY MOVEABLE SPHERE FULCRUM

(76) Inventor: Elysia Tsai, 100 S. Seranado St., Unit 105, Orange, CA (US) 92869

( * ) Notice: Subject to any disclaimer, the term of this patent is extended or adjusted under 35 U.S.C. 154(b) by 0 days.

(21) Appl. No.: 11/493,243

(22) Filed: Jul. 26, 2006

(65) Prior Publication Data

US 2007/0027010 A1 Feb. 1, 2007

Related U.S. Application Data

(60) Provisional application No. 60/703,197, filed on Jul. 28, 2005.

(51) Int. Cl.
*A63B 22/14* (2006.01)

(52) U.S. Cl. ..... 482/146

(58) Field of Classification Search ..... 482/34, 482/146–7, 79–80; D21/662
See application file for complete search history.

(56) References Cited

U.S. PATENT DOCUMENTS

| | | | | |
|---|---|---|---|---|
| 1,565,484 | A | 12/1925 | McWhirter | |
| 1,585,748 | A | 5/1926 | Wendelken | |
| 3,024,021 | A | 3/1962 | Coplin et al. | |
| 3,604,726 | A | 9/1971 | Tracy | |
| 3,716,229 | A | 2/1973 | Van Der Cleyen et al. | |
| 3,806,116 | A | 4/1974 | Malmberg et al. | |
| 3,862,768 | A * | 1/1975 | England | 280/205 |
| 3,895,794 | A * | 7/1975 | England | 482/146 |
| 3,961,787 | A | 6/1976 | Studebaker et al. | |
| 3,984,100 | A | 10/1976 | Firster | |
| 4,126,326 | A | 11/1978 | Phillips | |
| 4,191,371 | A * | 3/1980 | Armer, Jr. | 482/146 |
| 4,491,318 | A | 1/1985 | Francke | |
| 4,505,477 | A | 3/1985 | Wilkinson | |
| 4,601,469 | A * | 7/1986 | Sasser, Jr. | 482/146 |
| 4,653,748 | A | 3/1987 | Seel et al. | |
| 4,739,986 | A | 4/1988 | Kucharik et al. | |
| 4,759,542 | A | 7/1988 | Hudec | |
| 4,817,950 | A | 4/1989 | Goo | |
| 4,826,159 | A | 5/1989 | Hersey | |
| 5,048,823 | A | 9/1991 | Bean | |
| 5,062,629 | A | 11/1991 | Vaughan | |
| 5,092,586 | A | 3/1992 | Tuthill et al. | |
| 5,152,691 | A * | 10/1992 | Moscarello | 434/247 |
| 5,190,506 | A | 3/1993 | Zubik et al. | |
| 5,292,296 | A | 3/1994 | Davignon | |

(Continued)

FOREIGN PATENT DOCUMENTS

| | | |
|---|---|---|
| CA | 1264168 | 1/1990 |

(Continued)

*Primary Examiner*—Lori Amerson
(74) *Attorney, Agent, or Firm*—MacPherson Kwok Chen & Heid LLP; Tom Chen

(57) ABSTRACT

An adjustable balance board for use in rehabilitation, fitness training, and action sports such as skateboarding, snowboarding, and surfing comprises of a solid standing platform placed on top of a variety of fulcrums. The fulcrums include, but are not limited to, a fixed half sphere, a free rolling cylinder, and a free rolling sphere. A railing system on the underside of the board acts to contain the fulcrum within the available rolling space. The available rolling space is made adjustable by two removeable end stops, each with a mechanism that secures the end stop to the railing system.

22 Claims, 5 Drawing Sheets

U.S. PATENT DOCUMENTS

| | | | | |
|---|---|---|---|---|
| 5,328,421 | A | 7/1994 | Stanalajczo | |
| 5,368,536 | A | 11/1994 | Stodgell | |
| 5,399,140 | A | 3/1995 | Klippel | |
| 5,545,115 | A | 8/1996 | Corcoran | |
| 5,603,334 | A | 2/1997 | Sharp | |
| 5,643,154 | A | 7/1997 | Awbrey et al. | |
| 5,643,164 | A | 7/1997 | Teff | |
| D383,510 | S | 9/1997 | Bernardson | |
| 5,730,690 | A | 3/1998 | Guidry | |
| D398,671 | S | 9/1998 | Videtto | |
| 5,810,703 | A | 9/1998 | Stack | |
| D405,135 | S | 2/1999 | Scott | |
| 5,891,002 | A | 4/1999 | Maki | |
| 5,897,474 | A * | 4/1999 | Romero | 482/146 |
| 6,017,297 | A | 1/2000 | Collins | |
| 6,019,712 | A | 2/2000 | Duncan | |
| 6,168,551 | B1 * | 1/2001 | McGuinness | 482/51 |
| 6,315,695 | B1 | 11/2001 | Follett et al. | |
| 6,413,197 | B2 | 7/2002 | McKechnie et al. | |
| 6,419,586 | B1 | 7/2002 | Chiu | |
| D471,605 | S | 3/2003 | Teff | |
| 6,705,977 | B1 | 3/2004 | Ziak | |
| 6,811,523 | B1 | 11/2004 | Timmer | |
| 6,919,276 | B2 * | 7/2005 | Lee et al. | 438/692 |
| 7,156,790 | B2 * | 1/2007 | Johnsen | 482/146 |
| 2002/0008360 | A1 | 1/2002 | Ellington | |
| 2004/0023766 | A1 | 2/2004 | Slone | |
| 2004/0063556 | A1 | 4/2004 | Wischusen | |
| 2004/0198571 | A1 | 10/2004 | Brydson et al. | |
| 2004/0224824 | A1 | 11/2004 | Lickle | |
| 2005/0101441 | A1 | 5/2005 | Rosborouch et al. | |
| 2006/0270536 | A1 * | 11/2006 | Tukada | 482/146 |

FOREIGN PATENT DOCUMENTS

| | | |
|---|---|---|
| DE | 10138679 | 11/2002 |
| EP | 0464280 | 1/1992 |
| JP | 2002200192 | 7/2002 |
| WO | WO03105975 | 12/2003 |

* cited by examiner

ADJUSTABLE BALANCE BOARD WITH FREELY MOVEABLE SPHERE FULCRUM

CROSS REFERENCE TO RELATED APPLICATIONS

The present invention claims priority to U.S. Provisional Application Ser. No. 60/703,197, filed Jul. 28, 2005, and which is incorporated by reference in its entirety.

BACKGROUND

1. Field of Invention

This invention generally relates to fitness, health, training, developmental, rehabilitation, and sporting equipment and, more particularly, to balance boards.

2. Related Art

The importance of lower body balance for basic movement and injury prevention is supported by the training devices and force plates designed to quantify an individual's balance. Balance boards have long been used in the rehabilitation industry and for child motor skill development. There are different types of balance boards designed for ease of use or advanced skill. The balance board industry has recently gained attention from action sport enthusiasts, sport conditioning professionals, and the personal fitness industry.

A balance board requiring low skill level has an elongated or multiple fixed fulcrum points secured to the underside of a standing platform and allows movement in a side-to side or front-to-back direction. These balance boards, also known as rocker boards, are useful for individuals who have little balance ability and require an exercise with low level of skill. A balance board with a half sphere fulcrum allows movement in front, side, and diagonal directions. These types of balance boards are known as wobble boards. Transverse movement may be achieved if the user rotates the body. The skill level is more advanced than a rocker board and appropriate for an individual requiring balance skill simultaneously in three planes. While rocker and wobble boards are useful to train balance, they do not mimic actual sport movement that simultaneously combines all planes of unrestricted motion. Most of the standing platforms are also small in diameter or size and do not allow a wide stance for tall users.

Balance boards that incorporate greater instability and sport-like training are designed for advanced users. Advanced skill balance boards incorporate a movable fulcrum along the underside of a standing platform. This allows linear movement from side-to-side or front-to-back of the board on an unstable fulcrum. These fulcrums, or rollers, all have a common cylinder shape. The boards only allow side-to-side or front-to-back motion and make simultaneous movement in the sagital and frontal planes difficult or impossible. These types of balance boards are useful training devices for those with advanced skill. The cylindrical fulcrum also does not allow great movement in all planes simultaneously. Some balance boards incorporate end stops which limit the amount of rolling space for the cylinder fulcrum. A deficiency of adjustable end stops requires a screwdriver to remove screws. It is cumbersome to remove screws and replace the screws into a wooden board and hole that may strip over time and become ineffective at securing an end stop.

Advanced balance boards also incorporate a freely movable sphere along the underside length and width of the standing platform to allow greater mastery of skill and sport specific movement. The sphere gives the rider an unstable surface in front, side, and diagonal directions. It is advantageous to provide one balance board that allows a wide range of progression from a fixed fulcrum to a freely movable fulcrum to challenge balance in the transverse, sagital, and frontal planes. Current balance boards are using an air filled bladder as the fulcrum. This is problematic because the air filled bladder warps and becomes ineffective over time.

Some typical conventional balance boards can be classified based on (1) fixed elongated fulcrum, (2) fixed half sphere fulcrum, (3) adjustable fixed fulcrum, (4) fixed fulcrum with separate foot platforms, (5) two separate fixed fulcrums with one standing platform, (6) free moving, or rotating, cylindrical fulcrum contained to balance platform, (7) free moving cylindrical fulcrum on guide rail, (8) free moving cylindrical fulcrum on guide rail with adjustable end stops, (9) free moving cylindrical fulcrum without guide rail with fixed end stops, (10) free moving cylindrical fulcrum without guide rail with adjustable end stops, (11) free moving cylindrical fulcrum without guide rail and without end stops, (12) surfing simulators, (13) free moving sphere fulcrum with fixed end stops, and (14) balance boards with attachable weight systems.

In one, both standing platforms are used on top of a freely moving sphere to create the unstable standing surface. Different holes and recessed configurations for which the sphere would be placed have been used to give different degrees of difficulty. Also, a separate sphere contained on the underside of a sombrero shaped board is known. A current market balance board of similar design is the Balance 360° which has a flat standing platform and a circular retaining ring centered on the underside of the standing platform. The sphere fulcrum is contained within the circular retaining ring. A deficiency of this design is that an inflatable bladder used as the fulcrum which depresses and warps over time or when a heavy load is placed upon the standing platform. Secondly, the fixed retaining ring limits the amount of available fulcrum rolling space to the center of the board rather than using the entire board length. The retaining ring does not include adjustable end stops.

Therefore, there is a need for a balancing board that overcomes disadvantages of conventional balancing boards discussed above.

SUMMARY

Action sports may be seasonal, depend on weather conditions, or require extensive equipment. For example, skateboarding may be limited to the availability of a skate park with ramps, railing, or a concrete pool. Surfing may be limited to the timing of the tide schedule and weather. Snowboarding may be limited to availability of snow and ramps. With a sport simulating balance board, an individual can master tricks in a confined space without extensive equipment and at any given time. Sport body mechanics incorporate simultaneous movement in the sagital, coronal, and transverse planes. A balance board that simulates the natural movements of sport is the most effective training tool. To achieve such motion, a freely movable sphere fulcrum is needed. Currently, the available training devices do not offer such skill progression. Current training devices that use a sphere having an air filled bladder which depresses and warps over time making the fulcrum ineffective. One embodiment of the present invention uses a hard, non-deforming freely movable sphere as the fulcrum.

Balance is an integral part of daily living activities and athletic performance. Training on a device that can improve balance and strength of the body is essential to injury prevention, injury rehabilitation, and maintain a healthy body. When using a balance board, it is imperative to start with a low skill level to train the neuromusculature of the body and progress to a high skill level. A balance board that allows for the following progression of a rocker board, wobble board, a linear motion balance board, and finally to a fully unrestricted balance board that allows motion in all planes simultaneously is not currently known. One aspect of the present invention incorporates a half sphere that can be attached to adjustable end stops. If one half sphere is attached, the board acts as a wobble board. When two half spheres are attached, the board acts as a rocker board. The plurality of end stop placements allows for the fulcrum point to be placed anywhere along the length of the standing platform. Using a cylindrical fulcrum along any desired length of the board will achieve linear motion. Finally, using the sphere fulcrum along any desired length of the board will achieve unrestricted movement in all three planes in addition to linear motion. The cylinder or sphere can have restricted motion by use of the adjustable end stops. Conventional balance boards made of wood use screws placed into pre-drilled holes. The holes can strip over time and the requirement of an available screwdriver to change the position of the end stop can be time consuming and cumbersome. Another available balance board has a plastic end stop that is placed in one position at the end of the guide rail. The end stop can only be removed by prying it with a flathead screwdriver. One aspect of the present invention incorporates a mechanical end stop that is quick and efficient. The end stop can be removed entirely from the standing platform or adjusted along the length of the board. The advantage of adjustable end stops allows the user to contain the fixed or freely movable fulcrum to any position on the board.

Board sports such as skateboarding, surfing, snowboarding, skim boarding, and wake skating use a standing platform that has an upwardly curved nose and or tail. The nose and tail of the board are commonly used for tricks. Typical conventional balance boards that have an upward curved nose and tail contain the fulcrum to the straight part of the standing platform. To be able to practice sport specific skills it is essential to have a balance board that can use the nose and tail. One aspect of the present invention uses a railing system that allows the fulcrum to freely move under the upwardly pitched nose and tail. The adjustable end stop can also be placed near the nose or tail of the board to contain the fulcrum in the nose or tail to allow the rider to practice specific nose or tail tricks. For example, the rider is able to trap the sphere in the nose or tail and carve a turn in the transverse plane to simulate turning a surf board. The upward pitch of the nose and tail also creates variable speed when the fulcrum is situated under the upward curve. This increases the opportunity for more balance progression. In another embodiment, the board does not have an upward pitched nose or tail.

Therefore, the present invention, in various embodiments, provides numerous advantages, including providing a balance board that gives the user the capability of skill progression from low to highly advanced, providing a balance board with a railing system on the underside of the standing platform, providing a railing system which acts to contain the freely movable sphere within the underside surface of the standing platform, providing adjustable end stops secured within the railing system which varies the rolling space for the sphere, providing a balance board that can simulate dynamic sport movement and action sports such as skateboarding, surfing, wakeboarding, dirtboarding, etc., and providing attachable half spheres to allow the board to be used as a wobble board or rocker board.

These and other features and advantages of the present invention will be more readily apparent from the detailed description of the preferred embodiments set forth below taken in conjunction with the accompanying drawings.

BRIEF DESCRIPTIONS OF THE DRAWINGS

The following figures represent the balance board in limited views.

Figure 3:
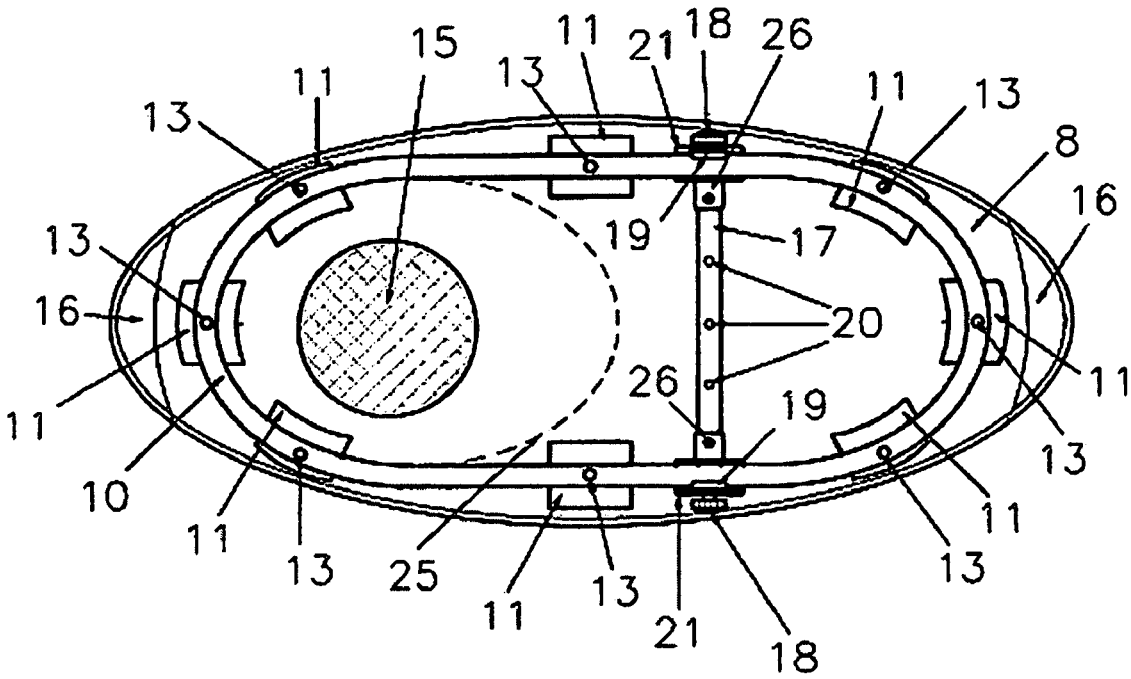

FIG. 3 is a bottom view of the underside of a balance board according to one embodiment. One adjustable end stop is placed on the right side of the board. The sphere fulcrum is shown in one possible position. An outline of the elliptical pattern of the railing system is shown. The eight railing mounts are shown.

Figure 4:
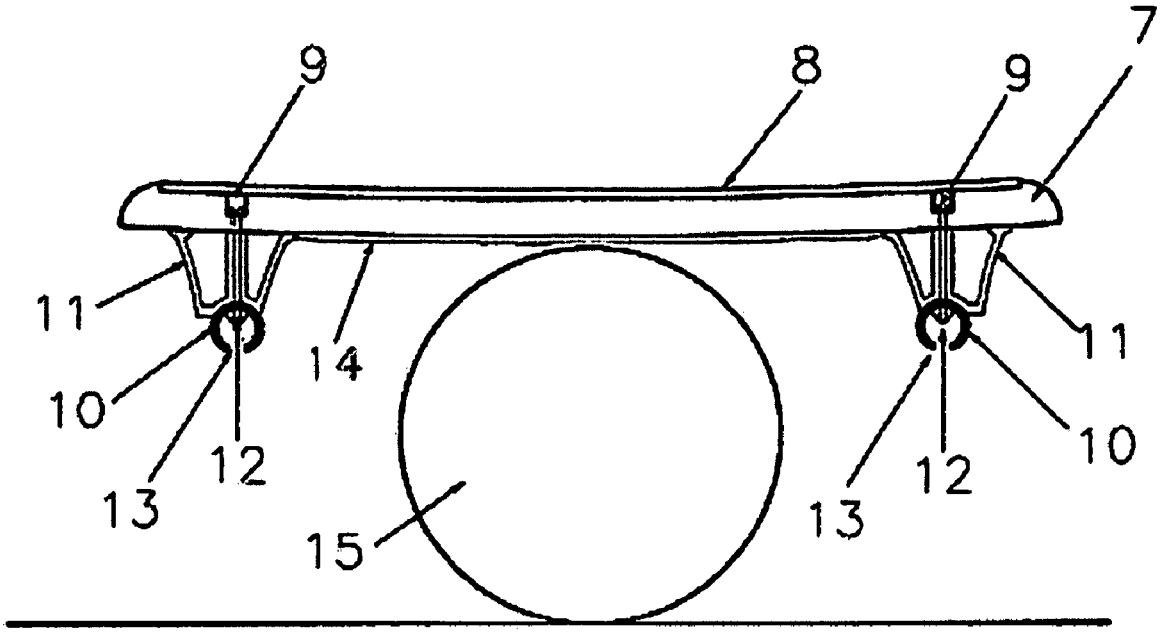

FIG. 4 is a cross section of a balance board according to one embodiment showing the standing platform, railing bolt, railing mount, bottom padding, and sphere fulcrum on ground level.

Figure 5:
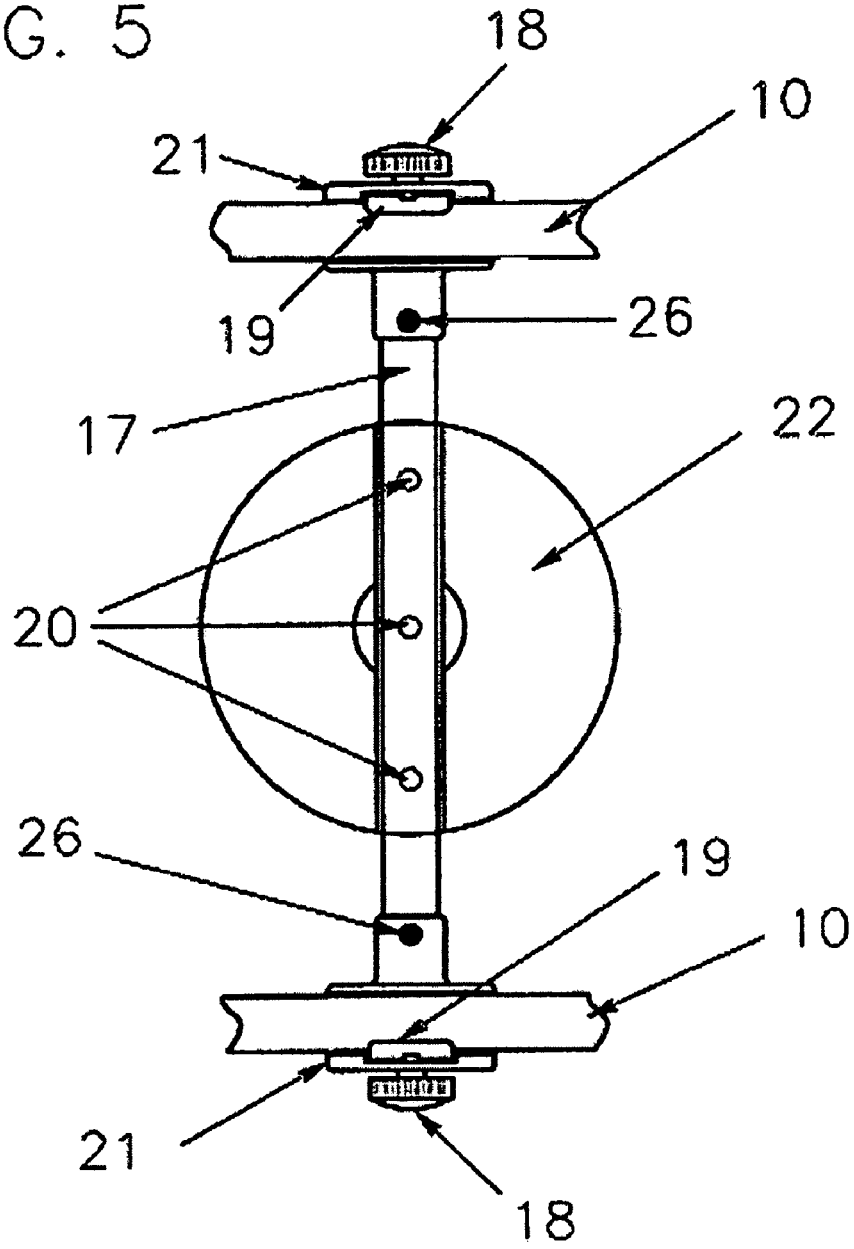

FIG. 5 is an exploded top view of a balance board according to one embodiment showing the end stop attachment to the railing system with attached half sphere.

Figure 6:
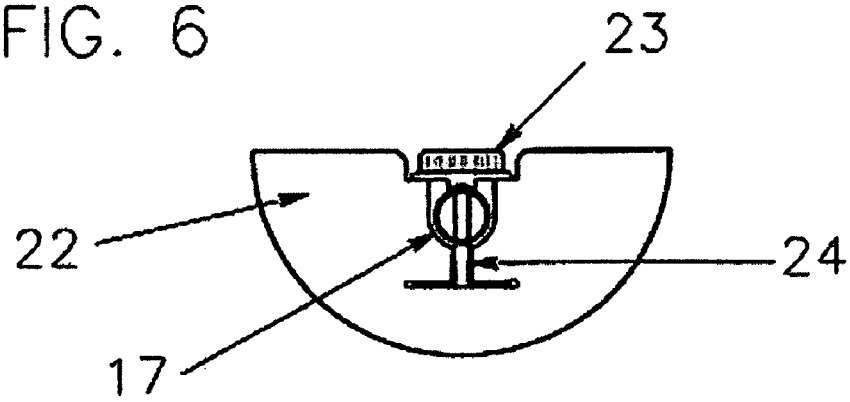

FIG. 6 is a cross section of a balance board according to one embodiment showing the half sphere attachment to the end stop.

Embodiments of the present invention and their advantages are best understood by referring to the detailed description that follows. It should be appreciated that like reference numerals are used to identify like elements illustrated in one or more of the figures.

DETAILED DESCRIPTION

Specific descriptions of the preferred embodiment respective to the figures are explained, however do not account for all positional possibilities, fulcrum size, board dimensions, railing dimensions and configurations, and end stop dimensions or mechanisms.

Figure 1:
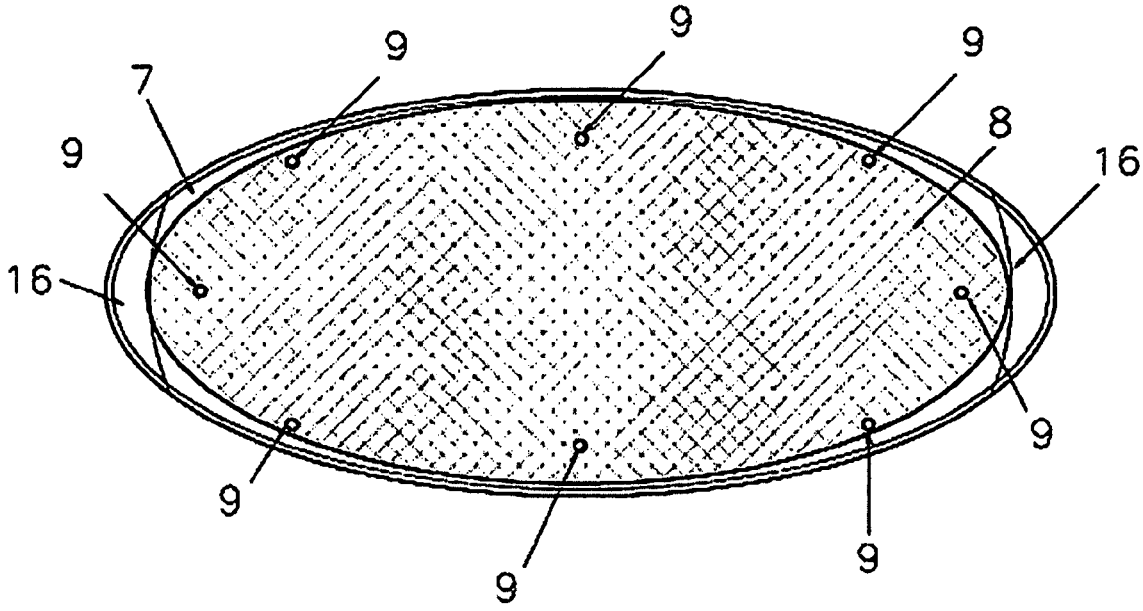
FIG. 1 is a top view of one embodiment of the present invention showing the standing platform and non-slip padding of a balance board.
Figure 2:
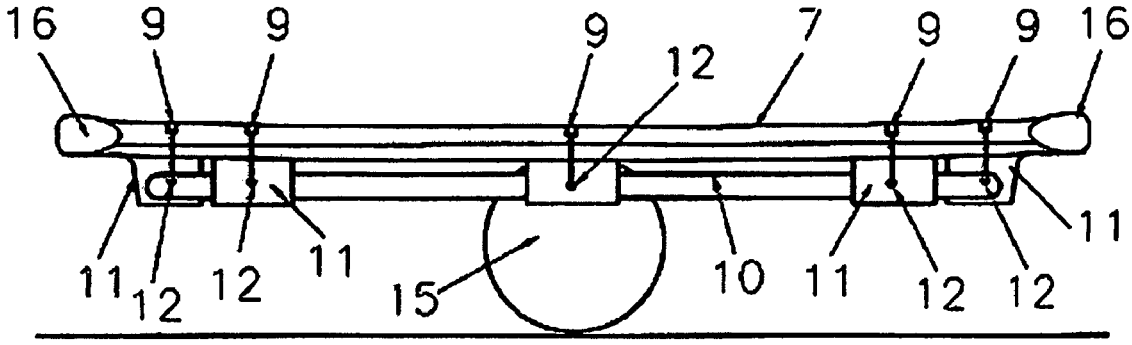
FIG. 2 is a side view of a balance board according to one embodiment showing the standing platform, the railing system, t-nuts and bolts through the rail mounts, and the free moving sphere fulcrum on ground level.

FIGS. 1 and 2 show top and side views, respectively, of a balance board according to one embodiment. A standing platform 7 has t-nuts 9 from the top that receive a railing bolt 12 (FIG. 2) from the bottom. A railing 10 can also be attached using a rivet, bolt and nut, or other type of securing method. The present embodiment uses a wood standing platform; however standing platform 7 can be made from a variety of materials including wood, plastic, glass, and metal. Using a variety of materials and methods for manufacture, standing platform 7 can be customized for strength, shape, and material properties. The dimensions of platform 7 also vary in length, width, and board thickness allowing the board to be customized to the height and weight of the user and specific skill being used for. Specifically, an individual who skateboards would most likely prefer a balance board that is similar to skateboard dimensions and an individual who surfs would prefer a balance board with similar dimensions to a surf board. The shape of platform 7 is also variable to having a square, round, or pointy nose and tail, a diamond-like shaped board, ovular shape, or other suitable shape.

Standing platform 7 has a top pad or non-slip surface 8 that can be adhered to the top of standing platform 7, such as with grip tape or rubber matting, and can be texturized during plastic production, or can be a textured lacquer applied to a wood standing platform 7. Non-slip surface 8 acts to provide stable footing while standing, kneeling, lying, or in a push-up position on platform 7. The present embodiment incorporates two end bumpers 16 made from a soft material that caps the ends of platform 7. Bumpers 16 can be attached using glue or remain removable and secured using the tensile properties of the material of bumper 16. The bumpers act to protect the ends of platform 7 from damage or from platform 7 damaging any nearby objects when learning new tricks or how to use the balance board.

FIG. 2 shows a longitudinal side view of the balance board of FIG. 1 using a freely movable sphere fulcrum 15. This embodiment shows a slightly upwardly curved standing platform 7, known as a continuous rocker, with each end of standing platform 7 being upwardly curved. Due to different manufacturing processes, standing platform 7 may be flat or have varying degrees of upward curve at the ends. Specifically, the nose and tail of platform 7 may be entirely flat as the length of the board or may have an upward contour to mimic a skateboard. The continuous rocker is an improvement to balance boards. The continuous rocker helps transfer momentum of the board from end to end when using sphere fulcrum 15. The transfer of momentum creates variability of speed and ease of use. The continuous rocker also allows the board to move in a motion that is more natural for swinging hip motion rather than lateral shifting of the hips.

The present embodiment shows end bumpers 16 capping the ends of the platform; however, the bumper can also be made to encase the entire perimeter of standing platform 7. T-nut 9 is inserted through the top of the standing platform 7 and through railing mounts 11 to receive a corresponding railing bolt 12 to hold railing 10 in place. In one embodiment, railing mount 11 is made from a semi-solid force absorbent material, which can be customized to various hardness. Railing mounts 11 absorb force from sphere fulcrum 15 hitting railing 10 or railing 10 hitting the ground. The force is then absorbed by railing mounts 11, which reduces the impact on standing platform 7 and consequently the individual using the balance board. Railing mount 11 is designed to not impede sphere fulcrum 15 from the available rolling space.

Sphere fulcrum 15 can be a solid sphere of various sizes and weights that does not allow depression and warping of the shape. "Solid" as used herein and the claims means that the sphere is hard and does not require the sphere to be completely solid; solid can mean a hard shell with a cavity within. Sphere fulcrum 15 is not contained or attached to the standing platform 7 but kept inside the railing system 10 by the use of the railing height. Current balance boards that have a sphere fulcrum use a light weight inflatable bladder that warps and becomes ineffective over time. Using a solid sphere fulcrum 15 made from a variety of plastic materials allows consistency over time. The weight of the current embodiment of sphere fulcrum 15 can also be altered. A weighted sphere makes for a smoother ride and better transfer of movement. For safety reasons, a solid sphere 15 is also advantageous when jumping standing platform 7 off sphere 15 and landing on a hard and consistent surface.

Although the present embodiment shows rail 10 made from a hollow metal tube, the general shape and dimensions of the tubing can be customized based on the size and shape of standing platform 7. The current embodiment shows railing 10 is not flush with standing platform 7, which allows the user a carrying handle or ease for hanging storage. Due to the large size of balance boards, it is difficult to carry or handle a balance board. The open space between rail 10 and standing platform 7 allows for different attachments to be secured within the open space. For example, a weight system or elastic bands can be attached to rail 10. This multifunctional railing 10 offers an advancement and variety to other balance boards.

Figure 2A:
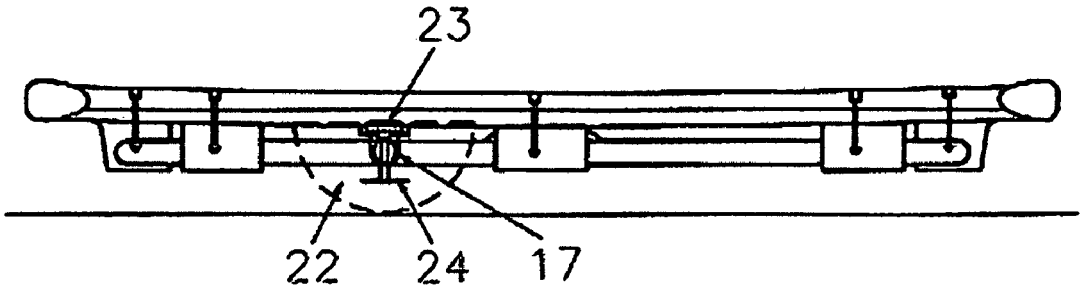
FIG. 2A is a side view of a balance board according to another embodiment showing the standing platform, the railing system, t-nut and bolts through the rail mounts, and outline of the end stop with attached half sphere on ground level.

FIG. 2A shows a longitudinal side view of a balance board according to one embodiment using an additional attachable half sphere 22 fulcrum to create a wobble or rocker board. As previously noted in FIG. 2, standing platform 7, t-nut 9, railing 10, railing mount 11, rail bolt 12, and end bumper 16 are the same. This embodiment shows attachable half sphere 22 on an attachable end stop 17. Half sphere 22 can be made from a variety of materials, such as wood, plastic, or metal. Due to the various manufacturing options, the half sphere can be customized in size, shape, and hardness. Half sphere 22 is attached to end stop 17 by a bolt 23 threaded through end stop 17 and screwed into a bolt receptor 24 located within half sphere 22. The bottom of half sphere 22 shown contacts the ground. The top of half sphere 22 contacts the bottom of standing platform 7 to distribute any torque or pressure placed on end stop 17.

End stop 17 can be placed along any open length of railing 10 where railing mounts 11 do not impede the attachment mechanism of end stop 17. End stop 17 acts to limit motion of the freely movable sphere fulcrum 15 or acts to place a fixed half sphere. The current embodiment shows one end stop 17 in place creating a wobble board. Attachable half sphere 22 can be placed in multiple areas of the railing 10 with creates a unique wobble board. Specifically, attachable half sphere 22 can be placed anywhere from between the individual rider's feet to under the foot to create different balance challenges. If two end stops 17, each with an attachable half sphere 22 were placed in railing 10, the board could be used as a rocker board. Again, the distance between the two half sphere 22 can be changed to create different balance challenges. Current balance boards do not allow the user to alter the distance between the fixed fulcrums. By having a wide distance between the fulcrums, the board becomes more stable for a lower skill level.

FIG. 3 shows the underside of one embodiment of a balance board detailing standing platform 7, railing 10, eight railing mounts 11, end bumper 16, and bolt holes 13 located on the underside of rail 10 to allow rail bolt 12 to fasten to t-nut 9. The freely moveable sphere fulcrum 15 is shaded and can move within the perimeter railing system. An elliptical path 25 is drawn to show the railing system follows the elliptical shape of standing platform 7. This elliptical path 25 helps create momentum transfer of sphere fulcrum 15 when in contact with an edge of rail 10 and sphere fulcrum 15 is approaching the end of rail 10 to transfer sphere 15 to the opposite side of rail 10. The shape of rail 10 is also extended near the end of standing platform 7 with allows the individual rider to move sphere fulcrum 15 various distances from under each foot. This shape of railing 10 and elliptical path 25 is not offered on any other balance boards that use a sphere fulcrum.

This embodiment shows one end stop 17 attached to rail 10 and located within the available rolling space for sphere fulcrum 15. End stop 17 acts as a limiter for sphere fulcrum 15 and can be placed in any open space on rail 10 along the width of standing platform 7. The end stop allows each individual rider to customize the available rolling space for sphere fulcrum 15. This is advantageous for users of different heights who have a wide or narrow stance, or for a beginning rider who requires a lower skill level and wants sphere 15 to move in a limited space. End stop 17 shown is straight shaped; however it can be shaped with any degree of curve to mimic the end of rail 10. End stop 17 shows three end stop holes for a bolt 20 allowing attachable half sphere 22 to be placed in the center or off center of the longitudinal midline of standing platform 7. Balance boards currently offering fixed fulcrum to create a wobble or rocker board all have centrally located fulcrum points under the user's foot. The present embodiment provides variability to locating the fulcrum under the forefoot, rearfoot, or center of the foot. Rather than rocking from side-to-side or front-to-back, the user can rock in a diagonal pattern by placing one pivot under the forefoot and one pivot under the rearfoot, while remaining in the midline of the standing platform.

The present embodiment of end stop 17 is attachable to rail 10 by a clamping mechanism of an end stop rail mount 21 secured to end stop 17 by an end stop rail mount screw 26. An end stop captured fastener 19 is pushed against rail 10 by an end stop securing bolt 18. To loosen end stop 17 and allow for adjustment along rail 10, end stop securing bolt 18 is turned counter clockwise to retract end stop captured fastener 19 from rail 10. The clamping mechanism is available on each end of end stop 17 which allows it to be displaced from railing 10.

FIG. 4 shows a cross section of standing platform 7 and railing system 10 according to one embodiment. The general shape of rail 10 is circular but can be made from any shape including square, rectangular, or triangular. Rail 10 is fastened to standing platform 7 by rail bolt 12 inserted through rail bolt hole 13 and through rail mount 11 and finally fastened to t-nut 9. Depending on the manufacturing options, rail 10 and rail mount 11 can also be made into one piece and connected to standing platform 7 or the entire system can be made as a unit. The present embodiment shows non-slip surface 8 on the top of standing platform 7 and also shows a bottom standing platform pad 14. Bottom standing platform pad 14 acts to provide a non-slip surface for freely moveable sphere fulcrum 15 and acts to provide some cushion between sphere 15 and standing platform 7. Bottom pad 14 can be adhered to standing platform 7 by glue or be manufactured as a unit with standing platform 7. Typical conventional balance boards do not provide a padding on the bottom, which may make the contact surface of the fulcrum and the bottom of the board slippery and unsafe.

FIG. 5 shows an exploded view of end stop 17 mechanism on a section of rail 10 with an attached half sphere 22 according to one embodiment. On each end of end stop 17 is end stop rail mount 21 that spans half of the underside of rail 10. End stop rail mount 21 is secured to end stop 17 by a mount screw 26. To secure end stop rail mount 21 to rail 10, an end stop captured fastener 19 contacts the side and portion of the bottom surface of rail 10. End stop securing bolt 18 is inserted through the outside of end stop rail mount 21 and connected to captured fastener 19. When end stop securing bolt 18 is rotated clockwise, it pushes captured fastener 19 against rail 10 to create a tight fit. A simple and quick adjustment can be made by loosening end stop securing bolts 18 and sliding end stop 17 along rail 10 to another position. This embodiment uses a clamping mechanism; however different manufacturing options can be used. For example, a quick release pin can be inserted through transverse holes through rail 10, a cam lock can be used, or an internal spring system within end stop 17 can apply pressure to the inside of rail 10.

Three end stop holes 20 for the half sphere bolt are shown on end stop 17. The variety of holes 20 allows for half sphere 22 to be placed in the center or off center of the longitudinal midline of standing platform 7. Current balance boards only provide a central fulcrum point. The present embodiment allows the user to customize the location of the fulcrum point of half sphere 22 as previously noted in FIG. 3.

FIG. 6 shows a cross section of attachable half sphere 22 and end stop 17. To attach half sphere 22 to end stop 17, attachable half sphere bolt 23 is inserted through a top of end stop hole 20 and connected to attachable half sphere bolt receptor 24. This embodiment incorporates an external threaded half sphere bolt 23 which matches with an internal threaded half sphere bolt receptor 24. Rotating half sphere bolt 23 clockwise will tighten end stop 17 and half sphere 22. Rotating half sphere bolt 23 counter clockwise will loosen end stop 17 and half sphere 22 and allow complete removal of half sphere 22 from end stop 17. Due to the different manufacturing options for half sphere 22, other types of fasteners can be used such as a ball detent pin, quick release pin, or snap fit. The size, weight, and density of half sphere 22 can also be customized. Specifically, an individual user who is rehabilitating an ankle injury may require a lower skill level and would choose a shorter half sphere 22 thereby limiting the height off the ground of standing platform 7. Conversely, a user who desires greater ankle range of motion could attach a taller half sphere 22 and create greater height of standing platform 7 from the ground and a greater challenge to balance.

Having thus described embodiments of the present invention, persons skilled in the art will recognize that changes may be made in form and detail without departing from the scope of the invention. Thus the invention is limited only by the following claims.

What is claimed is:

1. A balance board comprising:

a board having a top side, a bottom side, and an outer circumference;

a railing attached to the bottom side of the board;

a rigid sphere freely placed within the railing;

an end stop attachable to different portions of the railing; and a rigid semi-sphere having a planar side and a spherical side, wherein the planar side is attachable to different portions of the end stop.

2. The balance board of claim 1, further comprising:

a second end stop attachable to different portions of the railing; and a second rigid semi-sphere having a planar side and a spherical side, wherein the planar side is attachable to different portions of the end stop.

3. The balance board of claim 1, wherein the end stop is attachable to different portions along the length of the railing.

4. A balance board comprising:

a board having a top side, a bottom side, and an outer circumference;

a railing attached to the bottom side of the board; and a rigid sphere freely placed within the railing, wherein the railing is at least semi-absorbent.

5. The balance board of claim 1, further comprising mounts coupling the railing to the bottom of the board.

6. The balance board of claim 5, wherein the mounts are at least semi-absorbent.

7. A balance board comprising:

a board having a top side, a bottom side, and an outer circumference;

a railing attached to the bottom side of the board; and a rigid sphere freely placed within the railing, wherein the rigid sphere is weighted.

8. The balance board of claim 1, wherein the railing is within the outer circumference of the board.

9. A balance board comprising:

a board having a top side, a bottom side, and an outer circumference;

a railing attached to the bottom side of the board;

a rigid sphere freely placed within the railing; and padding between the bottom of the board and the rigid sphere.

10. A balance board comprising:

a board having a top side, a bottom side, and an outer circumference;

a railing attached to the bottom side of the board;

an end stop attachable to different portions of the railing; and a rigid semi-sphere having a planar side and a spherical side, wherein the planar side is attachable to different portions of the end stop.

11. The balance board of claim 10, further comprising a rigid sphere freely placed within the railing.

12. The balance board of claim 11, further comprising:

a second end stop attachable to different portions of the railing; and a second rigid semi-sphere having a planar side and a spherical side, wherein the planar side is attachable to different portions of the end stop.

13. The balance board of claim 10, wherein the end stop is attachable to different portions along the length of the railing.

14. The balance board of claim 10, wherein the railing is within the outer circumference of the board.

15. The balance board of claim 11, further comprising padding between the bottom of the board and the rigid sphere.

16. A balance board comprising:

a board having a top side, a bottom side, and an outer circumference;

a railing attached to the bottom side of the board;

a rigid sphere freely placed within the railing;

an end stop attachable to different portions of the railing; and a rigid semi-sphere having a planar side and a spherical side, wherein the planar side is attachable to different portions of the end stop.

17. The balance board of claim 16, further comprising:

a second end stop attachable to different portions of the railing; and a second rigid semi-sphere having a planar side and a spherical side, wherein the planar side is attachable to different portions of the end stop.

18. The balance board of claim 16, wherein the end stop is attachable to different portions along the length of the railing.

19. The balance board of claim 16, wherein the railing is within the outer circumference of the board.

20. The balance board of claim 16, further comprising padding between the bottom of the board and the rigid sphere.

21. A method of operating a balance board having a railing on a bottom side of the board, comprising:

freely placing a rigid sphere within the railing;

attaching a rigid semi-sphere to an end stop attached to the railing;

balancing a user on a top side of the board; and moving the end stop to another area of the railing.

22. A method of operating a balance board having a railing on a bottom side of the board, comprising:

freely placing a rigid sphere within the railing;

attaching a rigid semi-sphere to an end stop attached to the railing;

balancing a user on a top side of the board; and attaching a second rigid semi-sphere to a second end stop attached to the railing.

* * * * *